US009618878B2

(12) United States Patent
Uchida et al.

(10) Patent No.: US 9,618,878 B2
(45) Date of Patent: Apr. 11, 2017

(54) DEVELOPING DEVICE AND IMAGE FORMING APPARATUS INCLUDING SAME

(71) Applicant: KYOCERA Document Solutions Inc., Osaka (JP)

(72) Inventors: Kosuke Uchida, Osaka (JP); Mitsuhiro Goda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/193,951

(22) Filed: Jun. 27, 2016

(65) Prior Publication Data

US 2017/0023878 A1 Jan. 26, 2017

(30) Foreign Application Priority Data

Jul. 21, 2015 (JP) ..... 2015-143909

(51) Int. Cl.
*G03G 21/00* (2006.01)
*G03G 15/08* (2006.01)
*G03G 21/20* (2006.01)

(52) U.S. Cl.
CPC ..... *G03G 15/0846* (2013.01); *G03G 15/0898* (2013.01); *G03G 21/206* (2013.01)

(58) Field of Classification Search
CPC ..... G03G 15/0898; G03G 15/0846; G03G 21/206
USPC ..... 399/98
See application file for complete search history.

(56) References Cited

U.S. PATENT DOCUMENTS 7,587,154 B2 * 9/2009 Sakai ..... G03G 21/206 399/92
2003/0123898 A1 * 7/2003 Yoshiki ..... G03G 15/0898 399/98

FOREIGN PATENT DOCUMENTS

JP 2003-202751 A 7/2003
JP 2005-140971 A 6/2005

* cited by examiner

*Primary Examiner* — Hoang Ngo
(74) *Attorney, Agent, or Firm* — Stein IP, LLC

(57) ABSTRACT

A developing device according to the present disclosure includes a developer container, a duct, a duct coupling portion and a handle portion, and is removable with respect to an image forming apparatus. The duct is formed in the developer container and sucks floating toner together with air within the developer container. The duct coupling portion is formed at an end of the duct and is coupled to a toner suction portion of the image forming apparatus. The handle portion is formed in the shape of a flat plate and is formed to protrude from immediately below the duct coupling portion in a horizontal direction. A hollow portion is formed within the handle portion. A through hole is formed in a portion of an upper surface of the handle portion that is protruded as compared with an opening surface of the duct coupling portion and communicates with the hollow portion.

11 Claims, 11 Drawing Sheets

DEVELOPING DEVICE AND IMAGE FORMING APPARATUS INCLUDING SAME

This application is based upon and claims the benefit of priority from the corresponding Japanese Patent Application No. 2015-143909 filed on Jul. 21, 2015, the entire contents of which are incorporated herein by reference.

BACKGROUND

The present disclosure relates to a developing device which is removably fitted to an image forming apparatus such as a copying machine, a printer or a facsimile machine and to an image forming apparatus which includes such a developing device.

An image forming apparatus which uses an electrophotographic process includes a developing device which develops an electrostatic latent image on a photosensitive drum into a toner image. In a conventional image forming apparatus, since it may be necessary to provide maintenance and replacement to a developing device, the developing device is generally removable with respect to the main body of the image forming apparatus.

On the other hand, when toner is supplied from the developing device to the photosensitive drum, part of the toner may be scattered to leak from an opening portion of the developing device opposite the photosensitive drum, and thus the interior of the image forming apparatus may be contaminated. Hence, a configuration is proposed in which a duct is coupled to the developing device and in which the toner scattered in the vicinity of the opening portion of the developing device is collected with a suction device.

For example, a developing device is known which includes a developer regulation member that regulates the amount of developer on a developer carrying member and a scattering prevention member that is arranged so as to cover the developer passed through the developer regulation member, in which a recovery hole for recovering paper dust and floating toner is provided in the scattering prevention member and in which a fan for sucking air on the side of the developer carrying member through the recovery hole is also provided.

A scattering dust suction device is known that includes: a suction duct which has a plurality of suction ports and a plurality of air flow paths that individually communicate with the suction ports and that air flows for suction are independently passed through and in which the air flow paths are provided so as to prevent a normal vector to the suction port from being parallel to the direction of movement of the air flow within the air flow path; and a forced air flow generation device which is coupled to the individual air flow paths to forcefully generate air flows in the air flow paths. The scattering dust suction device sucks toner floating between an image carrying member and a developing device.

SUMMARY

A developing device according to a first aspect of the present disclosure includes a developer container, a duct, a duct coupling portion and a handle portion, and is removable with respect to the main body of an image forming apparatus. The developer container stores a developer. The duct is formed in the developer container and sucks floating toner together with air within the developer container. The duct coupling portion is formed at an end of the duct and is coupled to a toner suction portion on the side of the main body of the image forming apparatus. The handle portion is formed in the shape of a flat plate and is formed to protrude from immediately below the duct coupling portion in a horizontal direction. A hollow portion is formed within the handle portion. A through hole is formed in a portion of an upper surface of the handle portion that is protruded as compared with an opening surface of the duct coupling portion and communicates with the hollow portion.

Further objects of the present disclosure and specific advantages obtained by the present disclosure will be more apparent from embodiments to be described.

DETAILED DESCRIPTION

Figure 1:
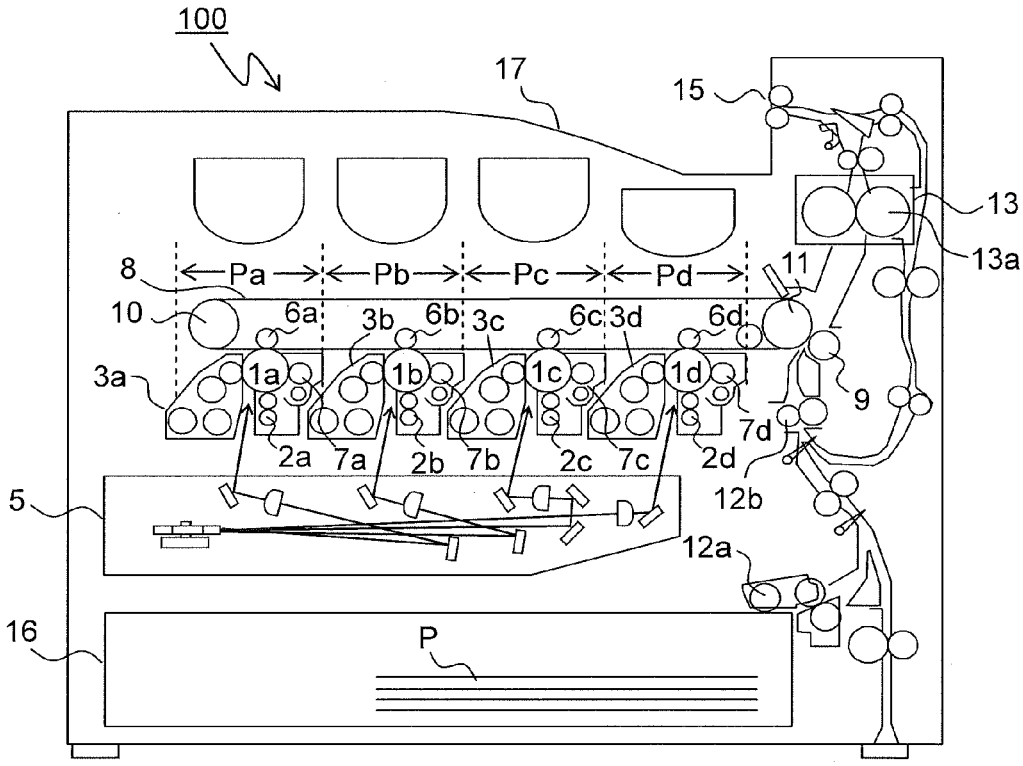
FIG. 1 is a schematic cross-sectional view showing the internal configuration of an image forming apparatus 100 which includes developing devices 3*a* to 3*d* of the present disclosure.

Embodiments of the present disclosure will be described below with reference to drawings. FIG. 1 is a cross-sectional view showing a schematic configuration of an image forming apparatus 100 which includes developing devices 3*a* to 3*d* of the present disclosure.

Within the main body of the image forming apparatus 100, four image forming portions Pa, Pb, Pc and Pd are arranged sequentially from the left side in FIG. 1. These image forming portions Pa to Pd are provided so as to correspond to the images of different four colors (magenta, cyan, yellow and black), and they sequentially form the images of magenta, cyan, yellow and black in the steps of charging, exposure, development and transfer.

In the image forming portions Pa to Pd, photosensitive drums 1*a* to 1*d* which carry the visible images (toner images) of the individual colors are respectively arranged, and in FIG. 1, an intermediate transfer belt 8 which is rotated in a counterclockwise direction is further provided adjacent to the image forming portions Pa to Pd.

A sheet P to which the toner image is to be transferred is stored within a sheet cassette 16 in a lower portion of the main body of the image forming apparatus 100, and is transported to a secondary transfer roller 9 through a paper feed roller 12*a* and a resist roller pair 12*b*.

The image forming portions Pa to Pd will then be described. Around and below the photosensitive drums 1*a* to 1*d* which are rotatably arranged, charging devices 2*a*, 2*b*, 2*c* and 2*d* which charge the photosensitive drums 1*a* to 1*d*, an exposure unit 5 which performs exposure on the photosensitive drums 1*a* to 1*d* based on image data, developing devices 3*a*, 3*b*, 3*c* and 3*d* which develop, with toner, electrostatic latent images formed on the photosensitive drums 1*a* to 1*d* and cleaning devices 7*a*, 7*b*, 7*c* and 7*d* which recover and remove the developer (toner) left after the transfer of the toner image on the photosensitive drums 1*a* to 1*d* are provided.

When image data is input from a higher-level device such as a personal computer, the surfaces of the photosensitive drums 1*a* to 1*d* are first uniformly charged by the charging devices 2*a* to 2*d*. Then, light is applied by the exposure unit 5 based on the image data, and thus electrostatic latent images corresponding to the image data are formed on the photosensitive drums 1*a* to 1*d*. The developing devices 3*a* to 3*d* include developing rollers (developer carrying members) arranged opposite the photosensitive drums 1*a* to 1*d*, and predetermined amounts of two-component developers containing the toners of the colors of magenta, cyan, yellow and black are individually put into the developing devices 3*a* to 3*d*.

Then, primary transfer rollers 6*a* to 6*d* apply a predetermined transfer voltage between the primary transfer rollers 6*a* to 6*d* and the photosensitive drums 1*a* to 1*d*. In this way, the toner images of magenta, cyan, yellow and black on the photosensitive drums 1*a* to 1*d* are primarily transferred onto the intermediate transfer belt 8. Thereafter, the toner left on the surfaces of the photosensitive drums 1*a* to 1*d* is removed by the cleaning devices 7*a* to 7*d*.

The intermediate transfer belt 8 is put over a driven roller 10 and a driving roller 11. The intermediate transfer belt 8 starts to rotate in a counterclockwise direction by the rotation of the driving roller 11 caused by a drive motor. Then, the sheet P is transported into a nip portion (secondary transfer nip portion) between the secondary transfer roller 9 provided adjacent to the intermediate transfer belt 8 and the intermediate transfer belt 8 with predetermined timing, and in the nip portion, a full-color image is secondarily transferred onto the sheet P. The sheet P to which the toner images are transferred is transported to a fixing device 13.

When the sheet P transported to the fixing device 13 is passed through the nip portion (fixing nip portion) of a fixing roller pair 13*a*, the sheet P is heated and pressurized, and thus the toner images are fixed to the surface of the sheet P, with the result that the predetermined full-color image is formed. The sheet P on which the full-color image is formed is ejected into an ejection tray 17.

Figure 2:
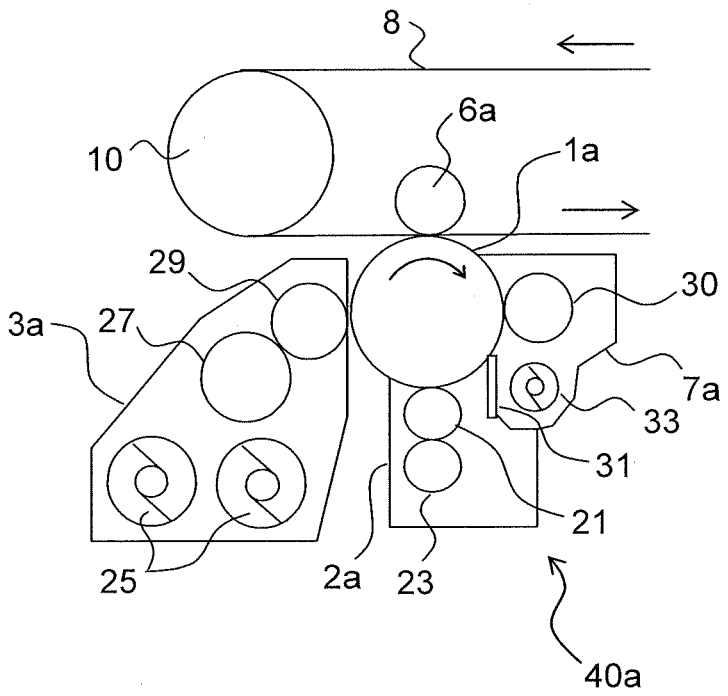
FIG. 2 is an enlarged cross-sectional view of the vicinity of an image forming portion Pa in FIG. 1.

The image forming portion Pa discussed above will then be described in detail. Since the image forming portions Pb to Pd basically have the same configuration as the image forming portion Pa, the detailed description thereof will be omitted. FIG. 2 is an enlarged cross-sectional view of the vicinity of the image forming portion Pa in FIG. 1. Around the photosensitive drum 1*a*, the charging device 2*a*, the developing device 3*a*, the primary transfer roller 6*a* and the cleaning device 7*a* described above are provided along the direction of the rotation of the drum (clockwise direction in FIG. 2). Among them, the primary transfer roller 6*a* is arranged in a position opposite the photosensitive drum 1*a* through the intermediate transfer belt 8.

The photosensitive drum 1*a*, the charging device 2*a* and the cleaning device 7*a* are integrated into a unit. Units that are formed with the photosensitive drums 1*a* to 1*d*, the charging devices 2*a* to 2*d* and the cleaning devices 7*a* to 7*d* in the image forming portions Pa to Pd are hereinafter referred to as drum units 40*a* to 40*d*.

The charging device 2*a* includes a charging roller 21 that makes contact with the photosensitive drum 1*a* to apply a charging bias to the surface of the drum and a charging cleaning roller 23 for cleaning the charging roller 21. The developing device 3*a* includes two agitation transport screws 25, a magnetic roller 27 and a developing roller 29, and applies a development bias of the same polarity (positive) as the charging polarity of the toner to the developing roller 29 to fly the toner to the surface of the drum.

The cleaning device 7*a* includes a rubbing roller (abrasive member) 30, a cleaning blade 31 and a collection spiral 33. The rubbing roller 30 is pressed onto the photosensitive drum 1*a* at a predetermined pressure, and is driven to rotate by a drum cleaning motor (not shown) in a contact surface with the photosensitive drum 1*a* in the same direction and its linear velocity is controlled to be higher than that of the photosensitive drum 1*a* (here, 1.2 times that of the photosensitive drum 1*a*).

On the downstream side in the rotation direction with respect to the contact surface of the photosensitive drum 1*a* with the rubbing roller 30, the cleaning blade 31 is fixed while being in contact with the photosensitive drum 1*a*.

The residual toner removed by the rubbing roller 30 and the cleaning blade 31 from the surface of the photosensitive drum 1*a* is discharged to the outside of the cleaning device 7*a* (see FIG. 2) by the rotation of the collection spiral 33.

Figure 3:
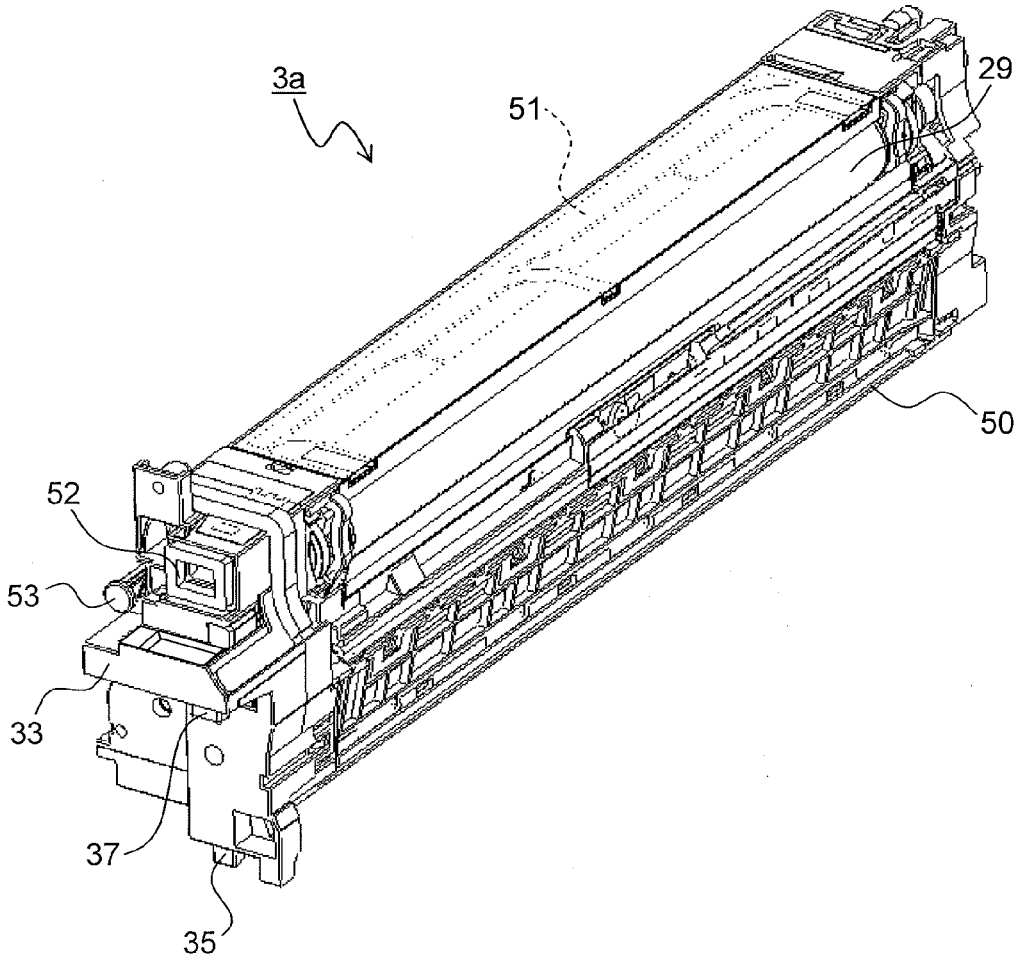
FIG. 3 is an external perspective view when the developing device 3*a* according to a first embodiment of the present disclosure is seen from the upstream side in a direction in which the image forming apparatus 100 is inserted.
Figure 4:
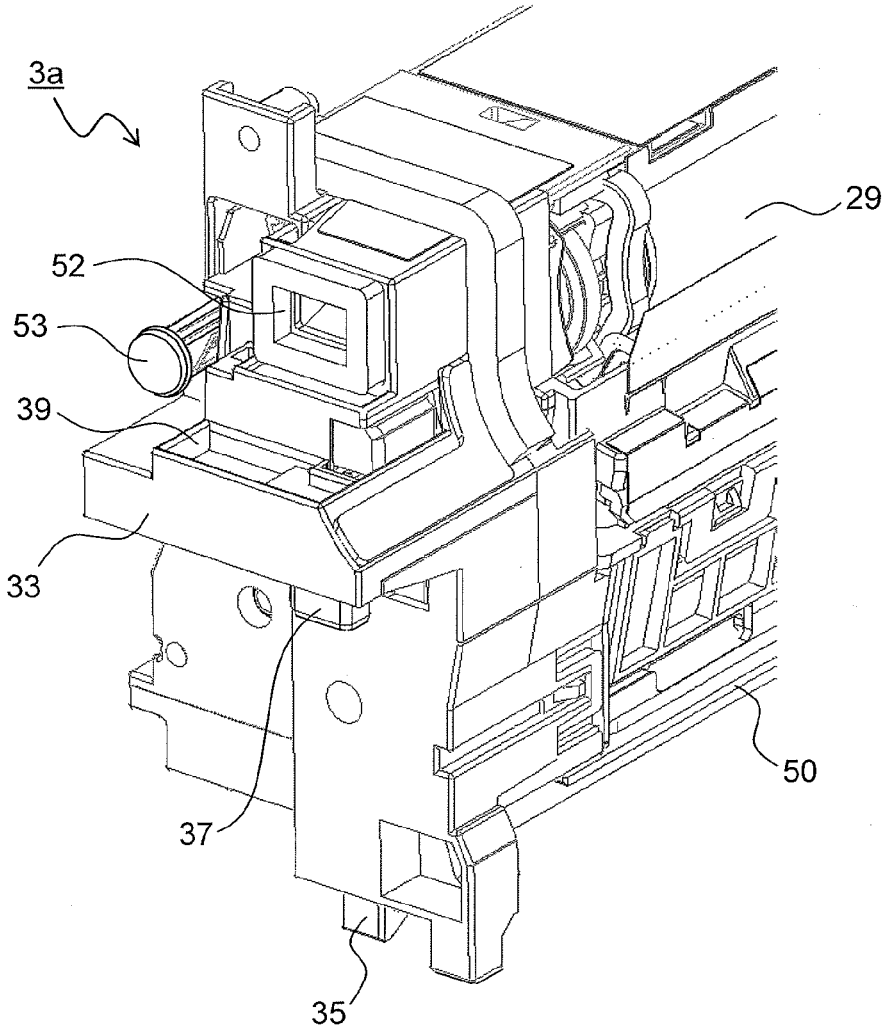
FIG. 4 is a partially enlarged view of an end portion of the developing device 3*a* of the first embodiment on the upstream side in the insertion direction.

FIG. 3 is an external perspective view when the developing device 3*a* according to a first embodiment of the present disclosure is seen from the upstream side in a direction in which the image forming apparatus 100 is inserted. FIG. 4 is a partially enlarged view of an end portion of the developing device 3*a* of the first embodiment on the upstream side in the insertion direction. Since the developing devices 3*b* to 3*d* basically have the same configuration as the developing device 3*a*, the description thereof will be omitted. The developing device 3*a* includes, within a developer container 50, the two agitation transport screws 25, the magnetic roller 27 (see FIG. 2 for both of them) and the developing roller 29 described previously. In the developer container 50, a toner supply port (not shown) which is connected to a toner supply portion (not shown) for supplying the toner from a toner container 4*a* (see FIG. 1) is formed. Through this toner supply port, the toner of the corresponding color (here, magenta) is supplied into the developing device 3*a*, and is used for the development of the electrostatic latent image.

The developing device 3*a* also includes a roller approach/separation mechanism that makes the developing roller 29 approach the photosensitive drum 1*a* or retracts the developing roller 29 from the photosensitive drum 1*a*. In the side surface of the developing device 3*a*, a shaft member (not shown) that forms the roller approach/separation mechanism is arranged. The shaft member is slidably arranged along a groove-shaped guide portion that is formed in the outer surface of the developer container 50 in the developing device 3*a*, and receives a force which is applied by a biasing member (not shown) such as a spring and which acts on the upstream side (the front side of the plane of sheet in FIG. 4) in the insertion direction of the developing device 3*a*. Then, the contact portion 53 of the shaft member is protruded from the end portion on the upstream side in the insertion direction of the developing device 3*a* opposite a waste toner collecting unit 70 (see FIG. 5) that is provided inside the open/close cover (not shown) of the image forming apparatus 100.

When the waste toner collecting unit 70 is opened, the shaft member is moved to the upstream side in the insertion direction by the biasing force exerted by the biasing member so as to be arranged in a retraction position in which the developing roller 29 is separate from the photosensitive drum 1*a*. In this way, the developing device 3*a* and the drum unit 40*a* can be removed in an arbitrary order without the developing roller 29 and the photosensitive drum 1*a* being damaged. After the insertion of the developing device 3*a* and the drum unit 40*a*, the waste toner collecting unit 70 is closed, and thus the contact portion 53 is pressed by the waste toner collecting unit 70, and the shaft member is moved to the downstream side in the insertion direction and is arranged in a development position in which the developing roller 29 is close to the photosensitive drum 1*a*.

In an upper portion of the developing device 3*a*, a duct 51 which has a plurality of air flow inlets (not shown) communicating with the interior of the developer container 50 is formed so as to be extended in the longitudinal direction of the developing device 3*a*. At the end portion of the developing device 3*a* on the upstream side in the insertion direction, a duct coupling portion 52 is formed that couples the duct 51 to the toner suction portion 71 (see FIG. 6) of the waste toner collecting unit 70.

At the end portion of the developing device 3*a* on the upstream side in the insertion direction, a handle portion 33 is provided that is grasped when the developing device 3*a* is inserted or removed with respect to the main body of the image forming apparatus 100. The handle portion 33 is formed immediately below the duct coupling portion 52 in the shape of a flat plate so as to be protruded in a horizontal direction (direction in which the toner suction portion 71 is coupled). In the upper surface of the handle portion 33, a through hole 39 is formed that communicates with a hollow portion 33*a* (see FIG. 9) formed within the handle portion 33.

Furthermore, at the end portion of the developing device 3*a* on the upstream side in the insertion direction, an engagement hook 35 that is engaged with a unit support tray (not shown) when the developing device 3*a* is inserted into the image forming apparatus 100 and a lock cancellation lever 37 that cancels the engagement of the engagement hook 35 are provided. The engagement hook 35 and the lock cancellation lever 37 form a lock mechanism that can hold the developing device 3*a* in a state where the developing device 3*a* is fitted to the main body of the image forming apparatus 100 and that can cancel the holding.

Although they are not shown in the figure here, handle portions are provided that are grasped when the drum units 40*a* to 40*d* are inserted or removed with respect to the image forming apparatus 100, engagement hooks that are engaged with the unit support tray when the drum units 40*a* to 40*d* are inserted into the image forming apparatus 100 and lock cancellation levers that cancel the engagement of the engagement hooks are also provided at the end portions of the drum units 40*a* to 40*d* on the upstream side in the insertion direction.

Figure 5:
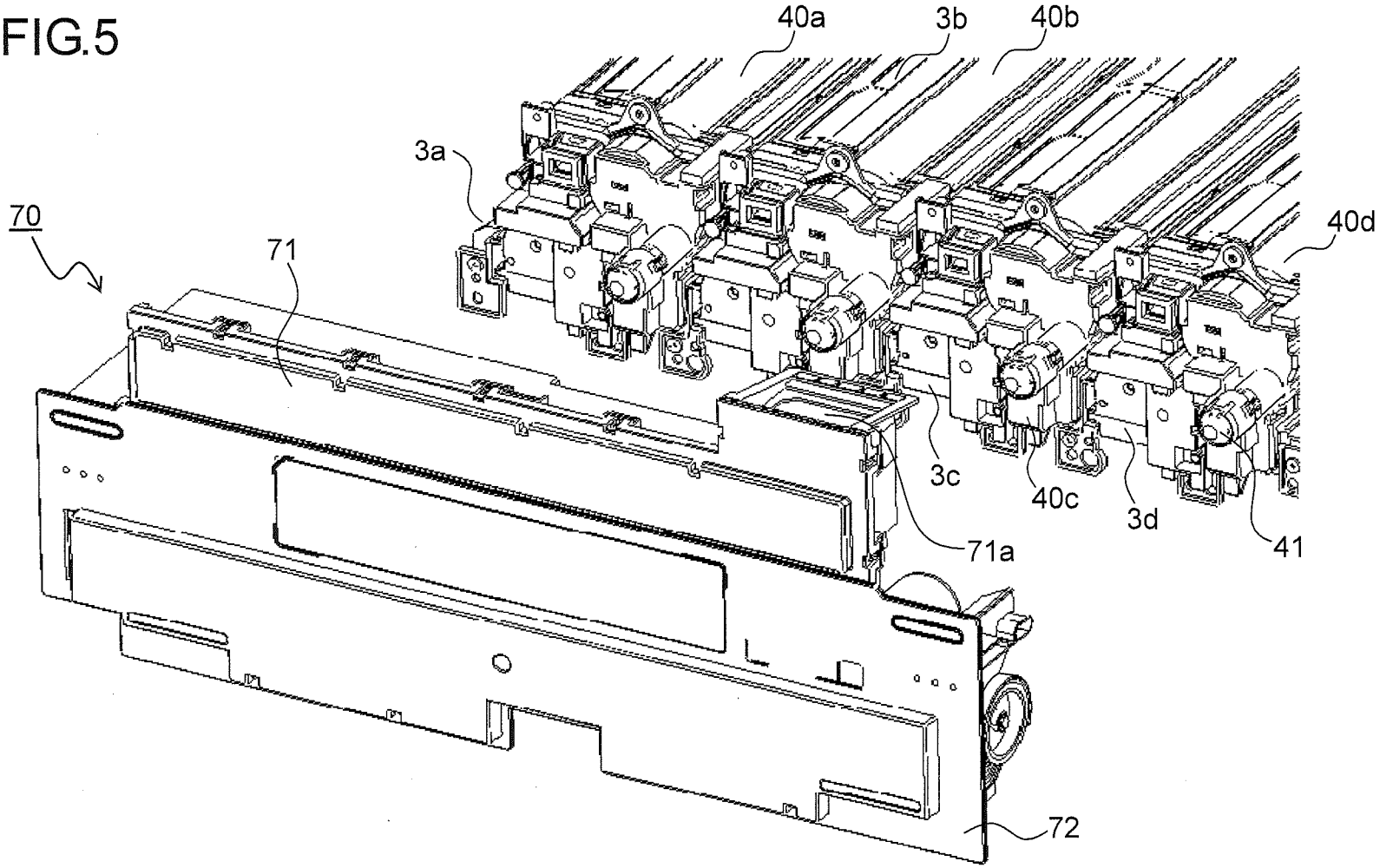
FIG. 5 is a perspective view showing one end portion of the developing devices 3*a* to 3*d* and drum units 40*a* to 40*d* in the first embodiment and a waste toner collecting unit 70 and is also a diagram showing a state where the waste toner collecting unit 70 is seen from a front surface side.
Figure 6:
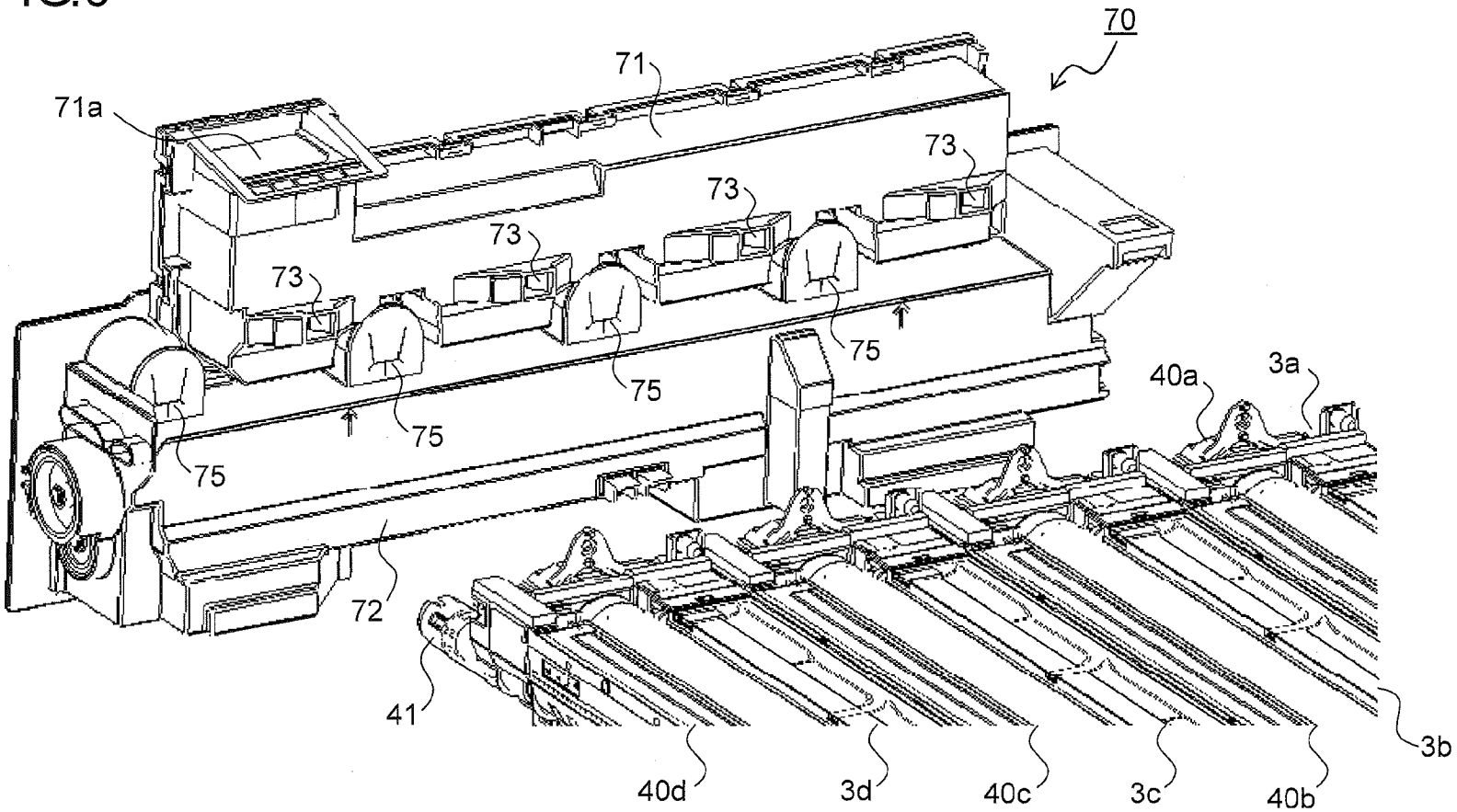
FIG. 6 is a perspective view showing the one end portion of the developing devices 3*a* to 3*d* and the drum units 40*a* to 40*d* in the first embodiment and the waste toner collecting unit 70 and is also a diagram showing a state where the waste toner collecting unit 70 is seen from a back surface side.
Figure 7:
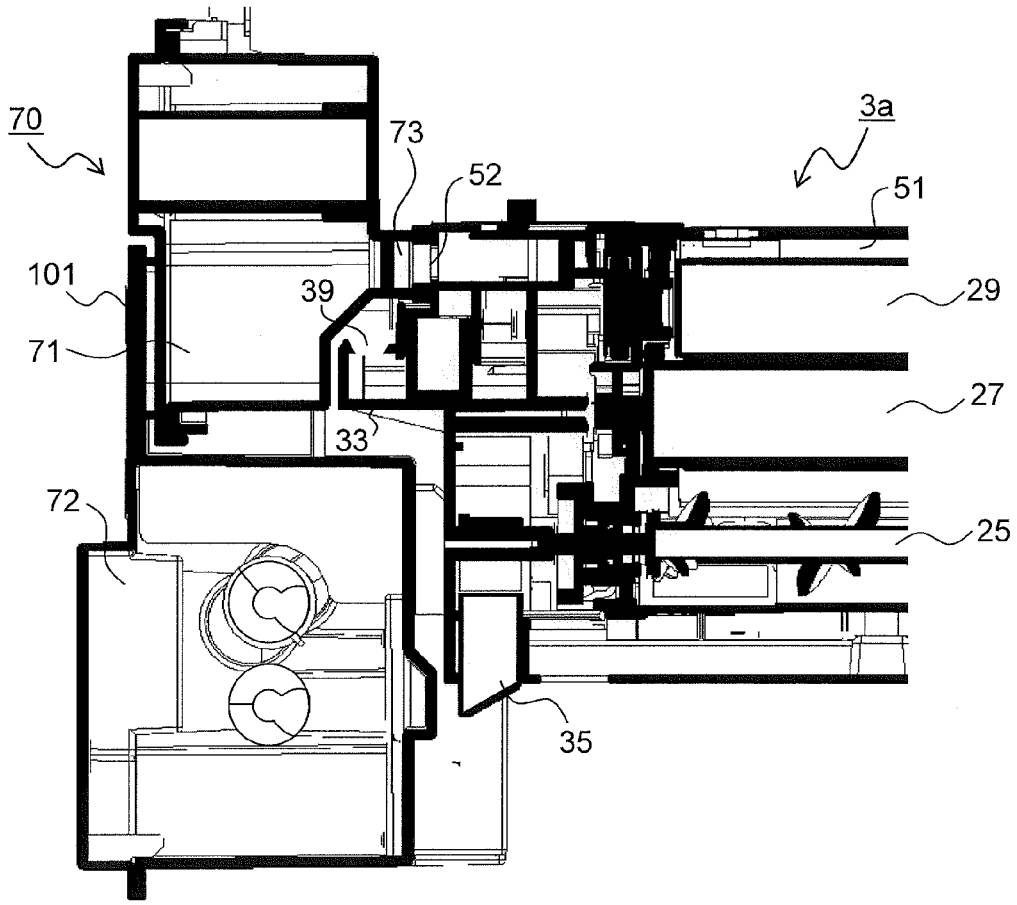
FIG. 7 is a side cross-sectional view showing a state where the developing device 3*a* of the first embodiment and the waste toner collecting unit 70 are coupled to each other.

FIGS. 5 and 6 are perspective views showing one end portion of the developing devices 3*a* to 3*d* and the drum units 40*a* to 40*d* in the first embodiment and the waste toner collecting unit 70 which is coupled to the one end of the developing devices 3*a* to 3*d* and the drum units 40*a* to 40*d*. FIG. 5 shows a state where the waste toner collecting unit 70 is seen from the front surface side (the outside of the image forming apparatus 100), and FIG. 6 shows a state where the waste toner collecting unit 70 is seen from the back surface side (the inside of the image forming apparatus 100). FIG. 7 is a side cross-sectional view showing a state where the developing device 3*a* of the first embodiment and the waste toner collecting unit 70 are coupled to each other. The configuration of the waste toner collecting unit 70 will be described below as necessary with reference to FIGS. 5 to 7.

The waste toner collecting unit 70 is arranged inside the open/close cover (not shown) provided on the front surface side of the image forming apparatus 100, and includes the toner suction portion 71 and a toner storage portion 72 provided below the toner suction portion 71. At the lower end portion of the waste toner collecting unit 70, a pivot point (not shown) is provided, and thus the waste toner collecting unit 70 can be opened or closed in an up/down direction with respect to the main body of the image forming apparatus 100.

In the toner suction portion 71, toner suction ports 73 are formed that are coupled to the duct coupling portion 52 of the developing devices 3*a* to 3*d*. On one end of the toner suction portion 71, an opening portion 71*a* is formed that is coupled to a suction fan (not shown) provided on the main body side of the image forming apparatus 100. In the opening portion 71*a*, a filter (not shown) is arranged, and the toner sucked from the toner suction ports 73 together with air is collected by the filter.

In an upper portion of the toner storage portion 72, coupling portions 75 to which the toner discharge portions 41 of the drum units 40*a* to 40*d* are coupled are formed. The toner discharge portions 41 are continuous in the axial direction of the collection spirals 33 (see FIG. 2) of the cleaning devices 7*a* to 7*d*, and are protruded on the end portions of the drum units 40*a* to 40*d* on the upstream side in the insertion direction. The waste toner which is collected from the surfaces of the photosensitive drums 1*a* to 1*d* by the cleaning devices 7*a* to 7*d* is discharged from the toner discharge portions 41 by the rotation of the collection spirals 33. A belt cleaner 19 (see FIG. 1) is also coupled to the toner storage portion 72, and the toner which is collected by the belt cleaner 19 from the surface of the intermediate transfer belt 8 is also stored in the toner storage portion 72.

In the state of FIG. 7, that is, in the state where the developing devices 3*a* to 3*d* and the drum units 40*a* to 40*d* are fitted into the main body of the image forming apparatus 100 and where the waste toner collecting unit 70 is closed, the duct coupling portions 52 of the developing devices 3*a* to 3*d* are coupled to the toner suction ports 73 formed in the toner suction portion 71 of the waste toner collecting unit 70. The toner discharge portions 41 (see FIG. 6) of the drum units 40*a* to 40*d* are coupled to the coupling portions 75 formed in the toner storage portion 72 of the waste toner collecting unit 70.

When in the state of FIG. 7, the suction fan (not shown) is driven, the floating toner within the developing devices 3*a* to 3*d* is sucked into the toner suction portion 71 through the ducts 51, the duct coupling portions 52 and the toner suction ports 73. The toner sucked into the toner suction portion 71 is collected by the filter provided in the opening portion 71*a*. On the other hand, the waste toner transported into the toner storage portion 72 from the toner discharge portions 41 through the coupling portions 75 is accumulated within the toner storage portion 72.

An operation for fitting and removing the developing devices 3*a* to 3*d* and the drum units 40*a* to 40*d* with respect to the image forming apparatus 100 will then be described. When in the state of FIG. 7, the waste toner collecting unit 70 is opened, the waste toner collecting unit 70 is separated from the developing devices 3*a* to 3*d* and the drum units 40*a* to 40*d*. Then, the coupling of the duct coupling portions 52 of the developing devices 3*a* to 3*d* and the toner suction ports 73 of the toner suction portion 71 is cancelled. The coupling of the toner discharge portions 41 of the drum units 40*a* to 40*d* and the coupling portions 75 of the toner storage portion 72 is also cancelled. In this way, it is possible to access the end portions of the developing devices 3*a* to 3*d* and the drum units 40*a* to 40*d* on the upstream side in the insertion direction.

For example, when the developing device 3*a* is removed from the image forming apparatus 100, the handle portion 33 and the lock cancellation lever 37 (see FIG. 4) formed at the end portion of the developing device 3*a* on the upstream side in the insertion direction are grasped simultaneously with a thumb and an index finger. Then, the lock cancellation lever 37 is pushed up to cancel the engagement between the engagement hook 35 provided in a lower portion of the front side of the developing device 3*a* and the unit support tray, and thus the developing device 3*a* is removed to the upstream side (the left side of FIG. 7) in the insertion direction.

On the other hand, when the developing device 3*a* is fitted into the image forming apparatus 100, the developing device 3*a* is inserted into the downstream side (the right side of FIG. 7) in the insertion direction. Then, when the developing device 3*a* is completely inserted, the engagement hook 35 is engaged with the unit support tray (not shown) on the main body side of the image forming apparatus 100, and thus the developing device 3*a* is held in a fitted state. The developing devices 3*b* to 3*d* and the drum units 40*a* to 40*d* can be fitted and removed with respect to the image forming apparatus 100 by the same operation.

Here, when the coupling of the duct coupling portions 52 of the developing devices 3*a* to 3*d* and the toner suction ports 73 of the toner suction portion 71 is cancelled, the waste toner left in the duct coupling portions 52 may be dropped to contaminate the interior of the image forming apparatus 100. When the dropped toner is adhered to a sheet transport path, a transport roller or the like, the sheet may be stained. When the dropped toner is adhered to a light emission window of the exposure unit 5, writing light for the photosensitive drums 1*a* to 1*d* may be interrupted to cause an image failure. Hence, in the developing devices 3*a* to 3*d* of the present embodiment, the hollow portion 33*a* is formed inside the handle portion 33 located below the duct coupling portion 52, and the through hole 39 which communicates with the hollow portion 33*a* is formed in the upper surface of the handle portion 33.

Figure 8:
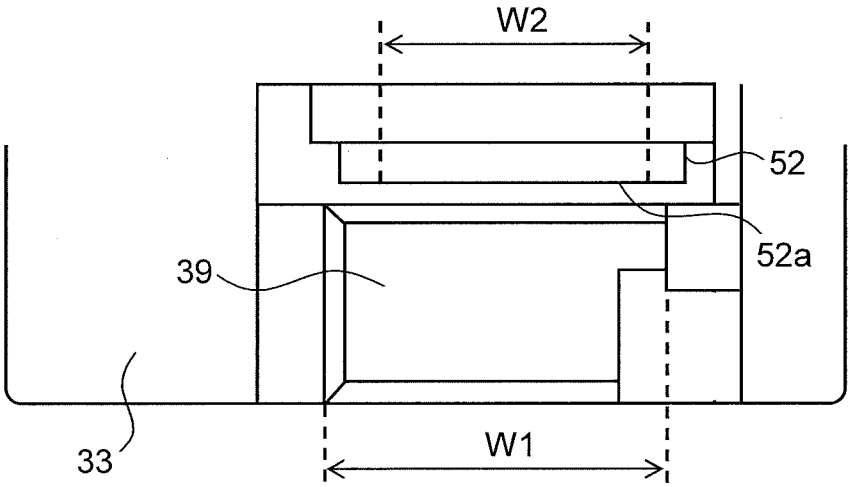
FIG. 8 is a plan view when the vicinity of a handle portion 33 in the developing device 3*a* of the first embodiment is seen from above.
Figure 9:
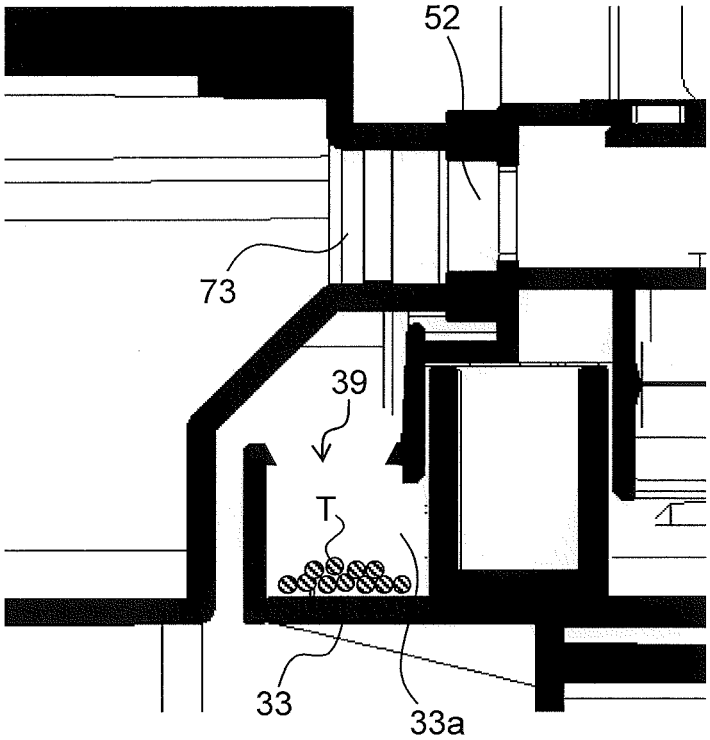
FIG. 9 is a partial cross-sectional view of the vicinity of the handle portion 33 in the developing device 3*a* of the first embodiment.

FIG. 8 is a plan view when the vicinity of the handle portion 33 in the developing devices 3*a* to 3*d* of the first embodiment is seen from above, and FIG. 9 is a partial cross-sectional view of the vicinity of the handle portion 33 in the developing devices 3*a* to 3*d* of the first embodiment. As shown in FIG. 8, the through hole 39 is formed in a portion of the upper surface of the handle portion 33 which is protruded as compared with the opening surface 52*a* of the duct coupling portion 52. The maximum opening dimension W1 of the through hole 39 in a width direction (direction parallel to the opening surface 52*a* of the duct coupling portion 52) is greater than the opening width W2 of the duct coupling portion 52, and the opening width W2 of the duct coupling portion 52 is included inside the maximum opening dimension W1 of the through hole 39.

As shown in FIG. 9, since the toner T dropped from the duct coupling portion 52 is passed through the through hole 39 and is dropped into the hollow portion 33*a*, the hollow portion 33*a* functions as a storage portion for the toner T. Since the toner which is temporarily stored in the hollow portion 33*a* is prevented from leaking to the outside when the developing devices 3*a* to 3*d* are removed, it is possible to effectively reduce the contamination of the interior of the image forming apparatus 100. Moreover, since the toner is unlikely to be adhered to the upper surface of the handle portion 33, it is possible to reduce the stain of the fingers when the developing devices 3*a* to 3*d* are removed.

When the color of the handle portion 33 is set at the same color as the toner stored in the developing devices 3*a* to 3*d*, even if part of the toner dropped to the handle portion 33 is adhered to the vicinity of the through hole 39, the adhesion of the toner is unlikely to be noticeable, with the result that it is possible to maintain the beauty of the interior of the image forming apparatus 100.

Figure 10:
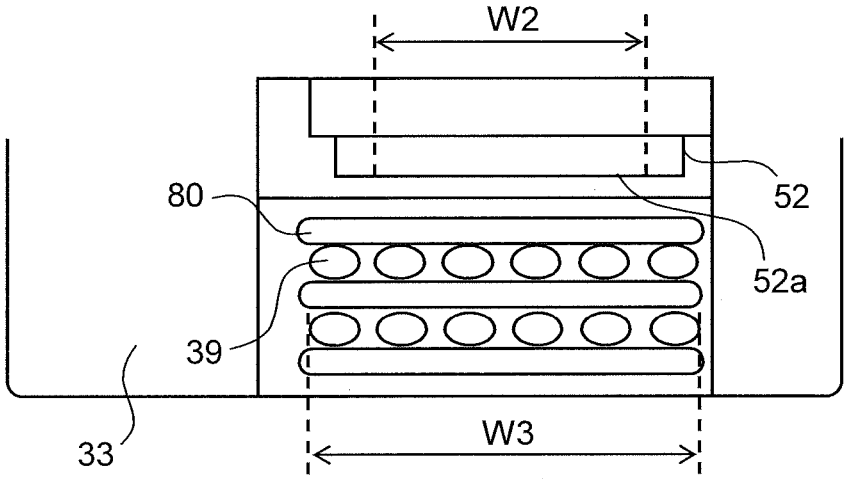
FIG. 10 is a plan view when the vicinity of a handle portion 33 in a developing device 3*a* according to a second embodiment of the present disclosure is seen from above.
Figure 11:
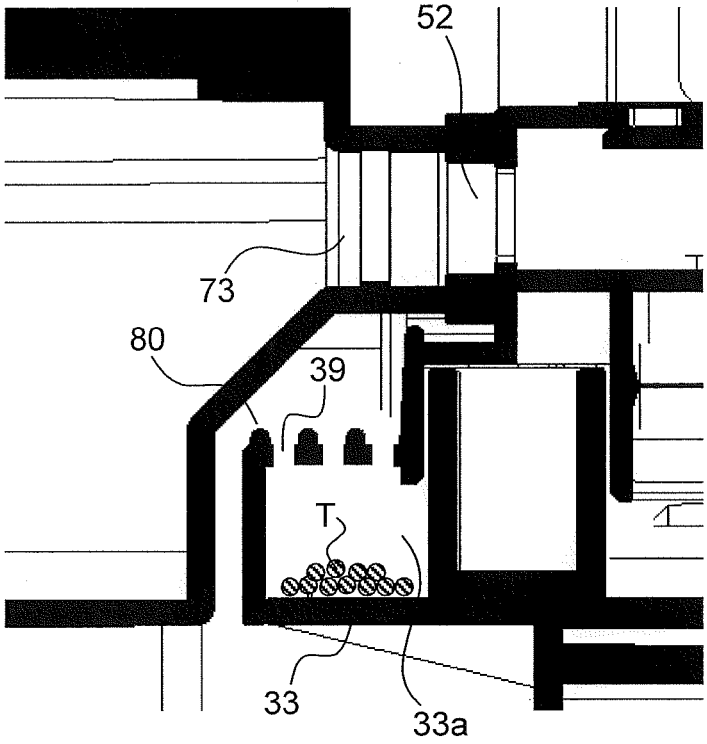
FIG. 11 is a partial cross-sectional view of the vicinity of the handle portion 33 in the developing device 3*a* of the second embodiment.

FIG. 10 is a plan view when the vicinity of a handle portion 33 in the developing devices 3*a* to 3*d* according to a second embodiment of the present disclosure is seen from above, and FIG. 11 is a partial cross-sectional view of the vicinity of the handle portion 33 in the developing devices 3*a* to 3*d* of the second embodiment. In the present embodiment, in the upper surface of the handle portion 33, a plurality of through holes 39 which communicate with the hollow portion 33*a* are formed, and a plurality of (here, three) ribs 80 which are extended parallel to the opening surface 52*a* of the duct coupling portion 52 so as to sandwich the through holes 39. Since the configurations of the other portions of the developing devices 3*a* to 3*d* are the same as in the first embodiment, the description thereof will be omitted.

As shown in FIG. 10, in a portion of the upper surface of the handle portion 33 which is protruded as compared with the opening surface 52*a* of the duct coupling portion 52, in a direction (the left/right direction of FIG. 10) parallel to the opening surface 52*a* of the duct coupling portion 52, a total of 10 through holes 39 are formed in two rows in each of which five through holes 39 are formed. A formation range W3 of the through holes 39 in the direction parallel to the opening surface 52*a* of the duct coupling portion 52 is greater than the opening width W2 of the duct coupling portion 52, and the opening width W2 of the duct coupling portion 52 is included inside the formation range W3 of the through holes 39.

In this configuration, as shown in FIG. 11, the toner T dropped from the duct coupling portion 52 is not dropped to slide from the upper surface of the handle portion 33 and is held between the ribs 80, is passed through the through holes 39 and is dropped into the hollow portion 33*a*, with the result that the hollow portion 33*a* functions as a storage portion for the dropped toner. Since the toner which is temporarily stored in the hollow portion 33*a* is prevented from leaking to the outside when the developing devices 3*a* to 3*d* are removed, it is possible to effectively reduce the contamination of the interior of the image forming apparatus 100 as in the first embodiment. Moreover, since the toner is unlikely to be adhered to the upper surface of the handle portion 33, it is possible to reduce the stain of the fingers when the developing devices 3*a* to 3*d* are removed. Furthermore, since the ribs 80 are formed so as to sandwich the through holes 39, the ribs 80 function as a non-slip portion, and the fingers are unlikely to touch the toner T adhered to the vicinity of the through hole 39 when the handle portion 33 is grasped.

Figure 12:
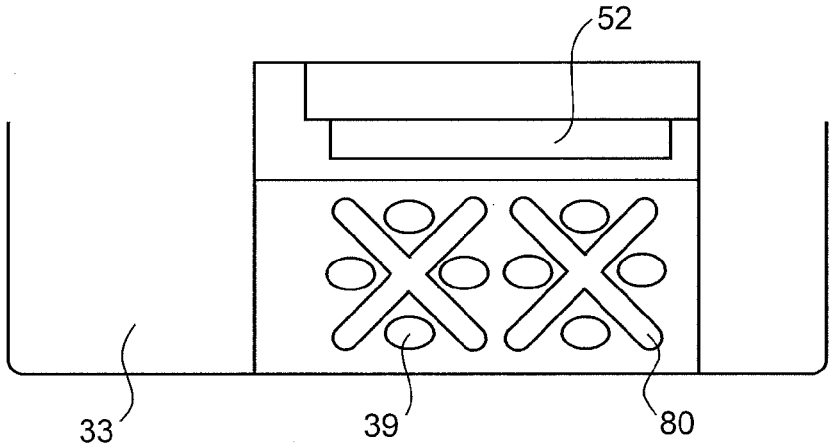
FIG. 12 is a plan view showing another configuration of the vicinity of the handle portion 33 in the developing device 3*a* of the second embodiment.

Although in the present embodiment, the ribs 80 which are extended parallel to the opening surface 52*a* of the duct coupling portion 52 are formed, the shape of the ribs 80 is not limited to this shape, and for example, a lattice shape as shown in FIG. 12 may be adopted. In this case, in order for the toner dropped from the duct coupling portion 52 to be prevented from being dropped to slide from the upper surface of the handle portion 33, a predetermined angle is preferably formed with respect to the direction of the opening (the up/down direction of FIG. 10) of the duct coupling portion 52. As in the first embodiment, the color of the handle portion 33 is preferably set at the same color as the toner stored in the developing devices 3*a* to 3*d*.

Figure 13:
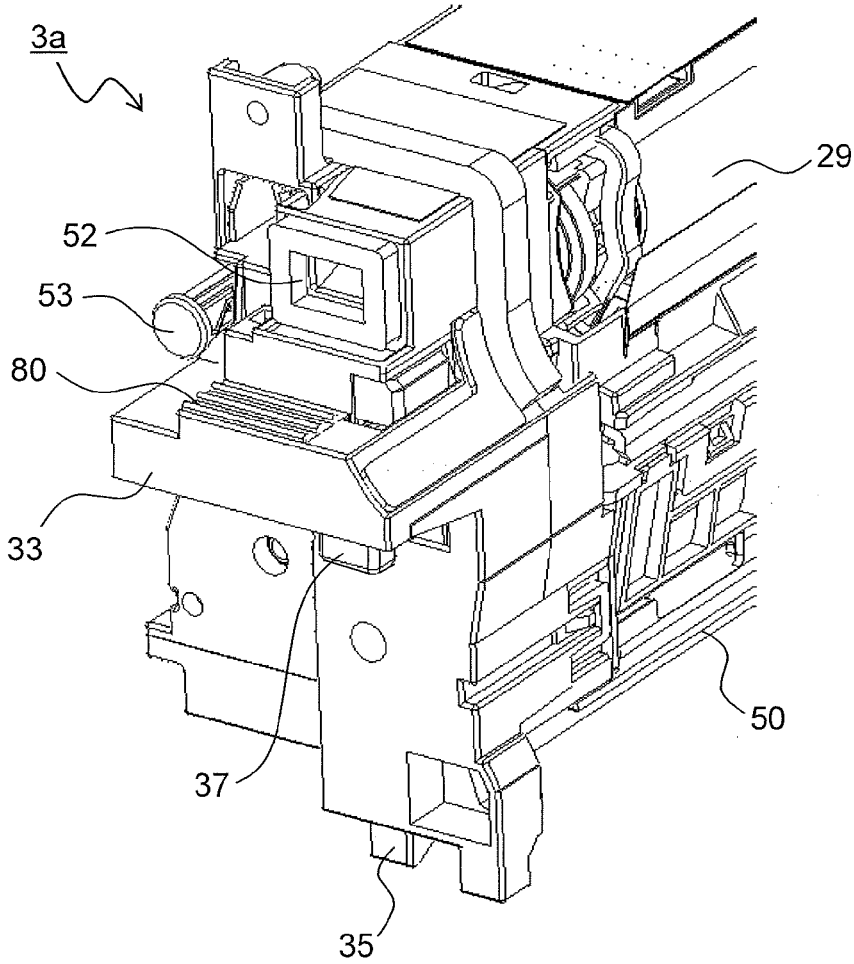
FIG. 13 is a partially enlarged view of an end portion of developing devices 3*a* to 3*d* according to a third embodiment of the present disclosure on the upstream side in the insertion direction.
Figure 14:
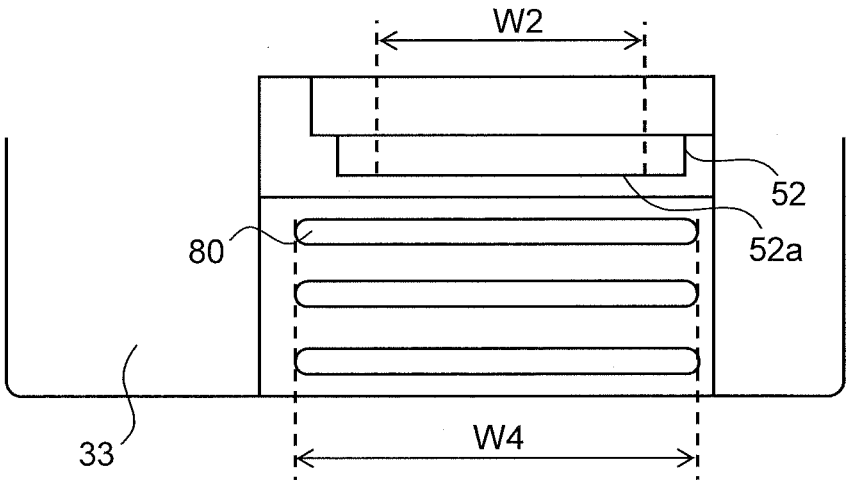
FIG. 14 is a plan view when the vicinity of a handle portion 33 in the developing device 3*a* of the third embodiment is seen from above.
Figure 15:
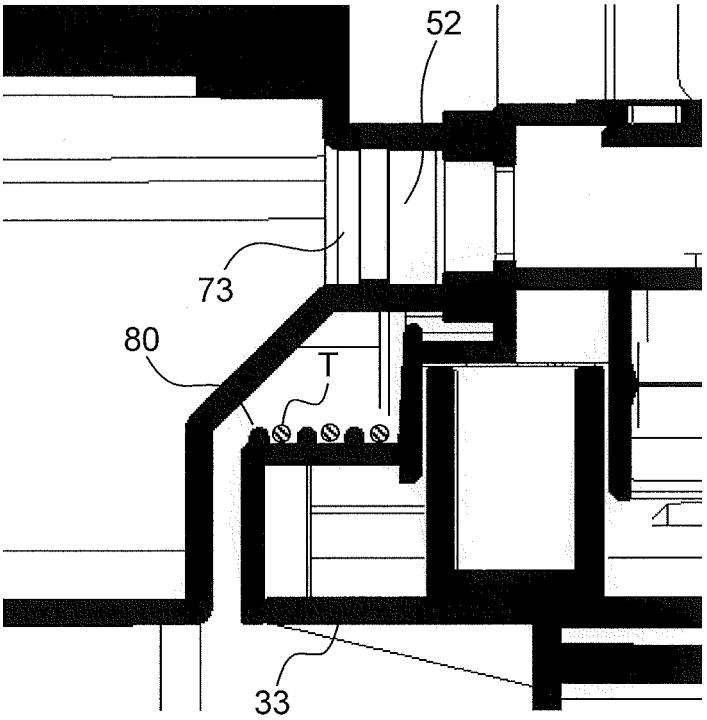
FIG. 15 is a partial cross-sectional view of the vicinity of the handle portion 33 in the developing device 3*a* of the third embodiment.

FIG. 13 is a partially enlarged view of an end portion of developing devices 3*a* to 3*d* according to a third embodiment of the present disclosure on the upstream side in the insertion direction, FIG. 14 is a plan view when the vicinity of a handle portion 33 in the developing devices 3*a* to 3*d* of the third embodiment is seen from above and FIG. 15 is a partial cross-sectional view of the vicinity of the handle portion 33 in the developing devices 3*a* to 3*d* of the third embodiment. In the present embodiment, on the upper surface of the handle portion 33, a plurality of ribs 80 which are extended parallel to the opening surface 52*a* of the duct coupling portion 52 are formed. The ribs 80 are formed in a portion which is protruded as compared with the opening surface 52*a* of the duct coupling portion 52. In the upper surface of the handle portion 33, no through hole 39 is formed. Since the configurations of the other portions of the developing devices 3*a* to 3*d* are the same as in the first and second embodiments, the description thereof will be omitted.

As shown in FIG. 14, in the portion of the upper surface of the handle portion 33 which is protruded as compared with the opening surface 52*a* of the duct coupling portion 52, three ribs 80 are formed in the direction (the left/right direction of FIG. 14) parallel to the opening surface 52*a* of the duct coupling portion 52. A formation range W4 of the ribs 80 in the direction parallel to the opening surface 52*a* of the duct coupling portion 52 is greater than the opening width W2 of the duct coupling portion 52, and the opening width W2 of the duct coupling portion 52 is included inside the formation range W4 of the ribs 80.

In this configuration, as shown in FIG. 15, the toner T dropped from the duct coupling portion 52 is not dropped to slide from the upper surface of the handle portion 33 and is held between the ribs 80. Thus, it is possible to reduce the contamination of the interior of the image forming apparatus 100 caused by the dropping of the toner. Moreover, since the ribs 80 function as a non-slip portion, and the fingers are unlikely to touch the toner T held between the ribs 80 when the handle portion 33 is grasped, it is possible to reduce the stain of the fingers when the developing devices 3*a* to 3*d* are removed.

In the shape of the ribs 80, a predetermined angle is preferably formed with respect to a direction (the up/down direction of FIG. 10) perpendicular to the opening surface 52*a* of the duct coupling portion 52 so that the toner dropped from the duct coupling portion 52 is unlikely to be dropped to slip from the upper surface of the handle portion 33. For example, a lattice shape as shown in FIG. 12 may be adopted. As in the first and second embodiments, the color of the handle portion 33 is preferably set at the same color as the toner stored in the developing devices 3*a* to 3*d*.

The present disclosure is not limited to the embodiments described above, and various modifications are possible without departing from the spirit of the present disclosure. For example, although the above embodiments are described using, as an example, the developing devices 3*a* to 3*d* in which the two-component developer is used to form a magnetic brush on the magnetic roller 27, in which only the toner is moved from the magnetic roller 27 to the developing roller 29 and in which the toner is flown from the developing roller 29 to the photosensitive drums 1*a* to 1*d*, as long as in a developing device, the toner suction portion 71 for sucking the scattered toner is coupled, the present disclosure can likewise be applied to other developing devices using other development methods such as a development method of bring the magnetic brush formed on the magnetic roller 27 into contact with the photosensitive drums 1*a* to 1*d* without using the developing roller 29.

The present disclosure can be applied not only to the color printer as shown in FIG. 1 but also to other image forming apparatuses such as a monochrome printer, a monochrome and color copying machine and a digital multifunctional machine (which has functions such as a copying machine, a facsimile machine and a scanner and which is also referred to as a MFP (Multi Functional Peripheral)).

The present disclosure can be utilized for an image forming apparatus that includes a developing device which is removably fitted with respect to the main body of the image forming apparatus. By the utilization of the present disclosure, it is possible to provide a developing device in which it is possible to prevent the contamination of the interior of an image forming apparatus caused by the dropping of toner from the coupling portion of a duct for sucking floating toner and the developing device and to provide an image forming apparatus including such a developing device.

What is claimed is:

1. A developing device comprising:

a developer container which stores a developer;

a duct which is formed in the developer container and which sucks floating toner together with air within the developer container;

a duct coupling portion which is formed at an end of the duct and which is coupled to a toner suction portion on a side of a main body of an image forming apparatus;

a handle portion which is formed in a shape of a flat plate and which is formed to protrude from immediately below the duct coupling portion in a horizontal direction;

a hollow portion which is formed within the handle portion; and a through hole which is formed in a portion of an upper surface of the handle portion that is protruded as compared with an opening surface of the duct coupling portion and which communicates with the hollow portion, wherein the developing device is removable with respect to the main body of the image forming apparatus.

2. The developing device according to claim 1, wherein a maximum opening dimension of the through hole in a direction parallel to the opening surface of the duct coupling portion is greater than an opening width of the duct coupling portion, and the opening width of the duct coupling portion is included inside the maximum opening dimension.

3. The developing device according to claim 1, wherein a plurality of the through holes are formed in the upper surface of the handle portion.

4. The developing device according to claim 3, wherein a formation range of the through hole in a direction parallel to the opening surface of the duct coupling portion is greater than an opening width of the duct coupling portion, and the opening width of the duct coupling portion is included inside the formation range of the through hole.

5. The developing device according to claim 3, wherein a plurality of ribs are formed in the upper surface of the handle portion so as to partition the through holes.

6. The developing device according to claim 5, wherein the ribs form a predetermined angle with respect to a direction perpendicular to the opening surface of the duct coupling portion.

7. The developing device according to claim 6, wherein the ribs are formed parallel to the opening surface.

8. The developing device according to claim 6, wherein the ribs are formed in a shape of a lattice so as to surround the through hole.

9. The developing device according to claim 5, wherein a formation range of the ribs in the direction parallel to the opening surface of the duct coupling portion is greater than the opening width of the duct coupling portion, and the opening width of the duct coupling portion is included inside the formation range of the ribs.

10. The developing device according to claim 1, wherein a color of the handle portion is the same as a color of the developer stored within the developer container.

11. An image forming apparatus comprising the developing device of claim 1.

* * * * *